US005390511A

United States Patent [19]

Shibata et al.

[11] Patent Number: 5,390,511

[45] Date of Patent: Feb. 21, 1995

[54] METHOD OF MANUFACTURING A JACQUARD PILE FABRIC AND SINKERS USED THEREIN

[75] Inventors: Takao Shibata, Osaka; Kiyoshi Hayashi, Hyogo, both of Japan

[73] Assignee: Precision Fukuhara Works, Ltd., Japan

[21] Appl. No.: 141,818

[22] Filed: Oct. 22, 1993

[30] Foreign Application Priority Data

Oct. 23, 1992 [JP] Japan ..... 4-309354
Aug. 27, 1993 [JP] Japan ..... 5-235400

[51] Int. Cl.[6] ..... D04B 9/12
[52] U.S. Cl. ..... 66/9 R; 66/92
[58] Field of Search ..... 66/9 R, 92, 93, 215, 66/217, 8, 12, 41

[56] References Cited

U.S. PATENT DOCUMENTS 4,926,660 5/1990 Takashi ..... 66/9 R

FOREIGN PATENT DOCUMENTS 0295703 12/1988 European Pat. Off. .
2038376 7/1980 United Kingdom .
2085035 4/1982 United Kingdom .
2160901 1/1986 United Kingdom .

*Primary Examiner*—Clifford D. Crowder
*Assistant Examiner*—John J. Calvert
*Attorney, Agent, or Firm*—Bell, Seltzer, Park & Gibson

[57] ABSTRACT

A method of and circular knitting machine for knitting jacquard pile fabric in which a ground yarn feeder section, two pile yarn feeder sections and a stitch forming section are provided and a ground loop forming sinker and a pile loop forming sinker are disposed in the same groove in the sinker cap and are individually and independently operated. The needles and sinkers are moved through the sections while forming ground yarn loops comprising a ground yarn needle loop and a ground loop forming sinker loop in the ground yarn feeder section and forming pile yarn loops in the pile yarn feeder sections. The ground loop forming sinkers are movable adjustably to push the ground yarn loops an amount sufficient to ensure that enough ground yarn is available at the needles in the stitch forming section to ensure proper stitch formation without risking yarn breakage. The ground loop forming sinkers hold the ground loops in a first sinker throat separate from the pile yarn loops to ensure stable plating in the knit fabric.

9 Claims, 6 Drawing Sheets

METHOD OF MANUFACTURING A JACQUARD PILE FABRIC AND SINKERS USED THEREIN

FIELD OF THE INVENTION

This invention relates to a method of knitting a jacquard pile fabric on a circular knitting machine and more particularly to such a method and two types of controllable sinkers used therein.

BACKGROUND OF THE INVENTION

This invention constitutes an improvement over U.S. Pat. No. 4,926,660, issued May 22, 1990, entitled "Method Of Knitting Jacquard Knit Fabric By Circular Knitting Machine" and assigned to the same assignee as this application. While successful in providing a higher density Velour-type jacquard knit fabric, the method of U.S. Pat. No. 4,926,660 contemplates a single type of sinker operating between each adjacent pair of cylinder needles. Such sinkers may result in ground yarn breakage because each cylinder needle secures the ground yarn in a straight line from the ground yarn feeder to the stitch section. While a circular knitting machine using two types of controllable sinkers has been heretofore proposed in Japanese Patent Examined Publication No. 27503/86, stable plating of the ground and pile yarns may be difficult to ensure since the ground and pile yarns secured by the cylinder needles are not held in proper position between the yarn feed section and the stitch sections.

SUMMARY OF THE INVENTION

With the foregoing in mind, it is an object of the present invention to provide a method of knitting a jacquard pile fabric on a circular knitting machine in which ground yarn breakage is avoided and stable plating of the ground and pile loops is ensured.

The present invention accomplishes this object by providing two types of independently controlled sinkers in each groove of the sinker cap of the circular knitting machine. The first of these sinkers is a ground loop forming sinker and the second is a pile loop forming sinker. In addition to being controlled independently of the pile loop forming sinker, the ground loop forming sinker is forwardly and backwardly adjustable for varying the loop length of the ground yarn loops to ensure that a sufficient amount of ground yarn is available for the formation of stitch loops at the stitch section without any possibility of ground yarn breakage. In addition, the ground loop forming sinker and the pile loop forming sinker hold the ground yarn and the pile yarns separately until the same are formed into stitch loops and pile loops in the stitch section. Stable plating of the ground and pile yarn loops is thusly ensured.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
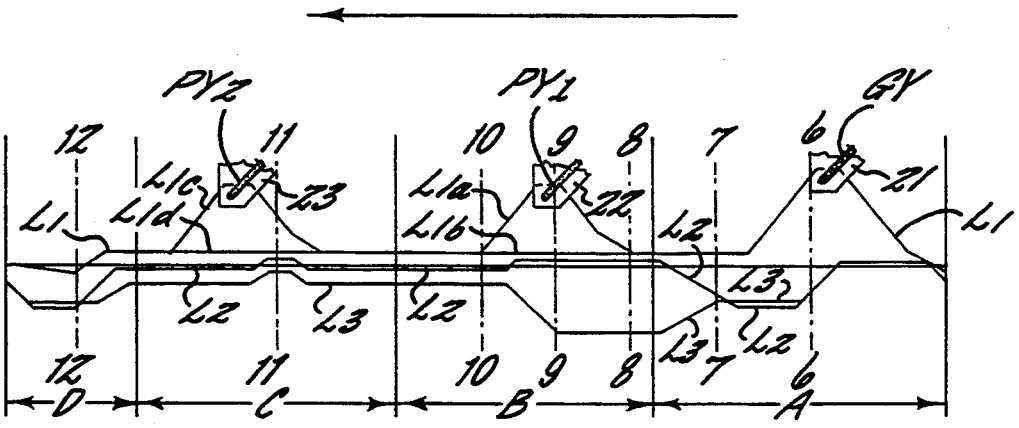
FIG. 1 is a schematic developed view of the knitting process of an embodiment of the method of the present invention.

Referring now more particularly to FIG. 1, there is schematically illustrated the knitting of a two-color jacquard fabric in which a repeated three-feeder knitting procedure is utilized in accordance with the present invention. The first feeder section is referenced by A in FIG. 1 and represents the feeder for the ground yarn GY which is fed to the needles 20 by a ground yarn carrier 21.

Figure 2:
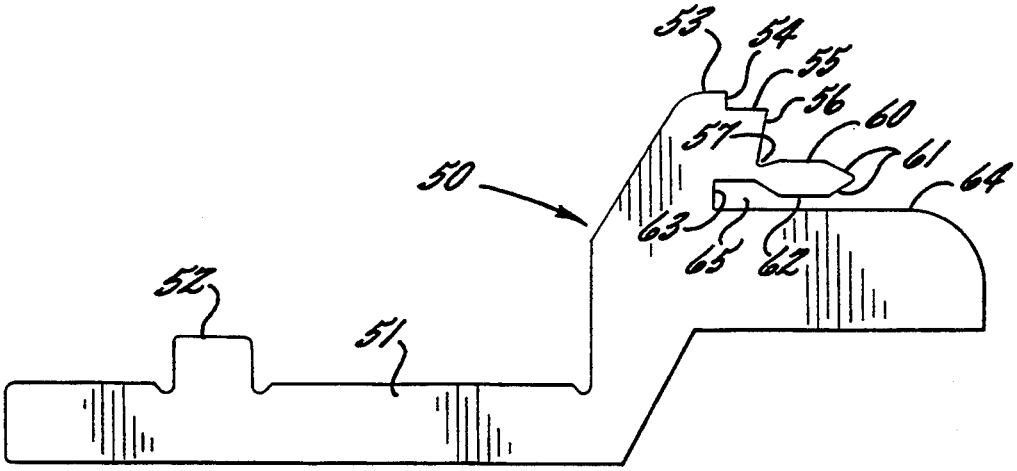
FIG. 2 is a side elevational view of an embodiment of the pile loop forming sinker of the present invention.
Figure 3:
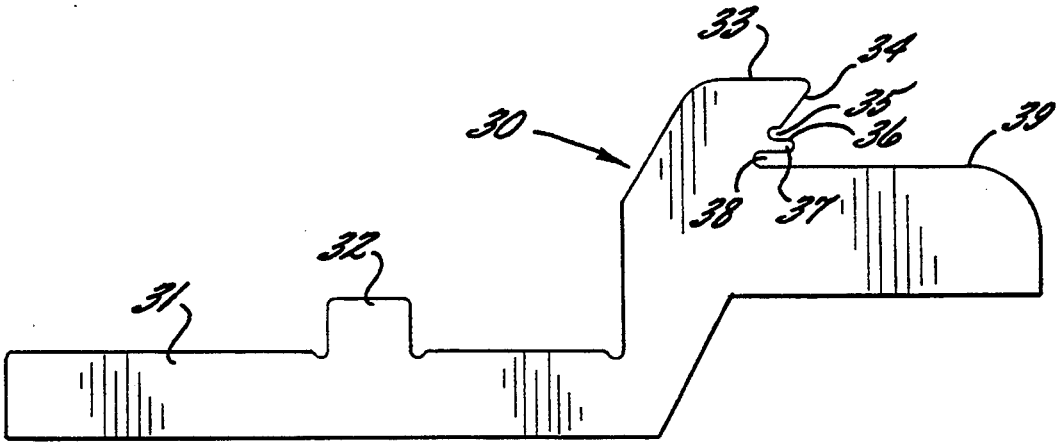
FIG. 3 is a side elevational view of the embodiment of the ground loop forming sinker of the present invention.

The second feeder section is referenced by and represents the feeder for a first pile yarn PY-1 which is fed to selected ones of the needles 20 by a yarn carrier 22. The third feeder section is referenced by C in which a second pile yarn PY-2 is fed to selected ones of the needles 20 by a yarn carrier 23. The stitch forming section is referenced by D and it is in this section D that stitches are formed of the ground yarn GY and the pile yarns PY-1 and PY-2. Cooperating with the needle 20 in knitting the jacquard fabric are ground loop forming sinkers 30 and pile loop forming sinkers 50 (FIGS. 2 and 3). A ground loop forming sinker 30 and a pile loop forming sinker 50 are disposed in side-by-side relation in each groove in the sinker cap (not shown) between each adjacent pair of needles 20. Sinkers 30 and 50 are mounted for independent movement inwardly and outwardly relative to needles 20.

In FIG. 1, there is illustrated by line L-1 the performance of the cylinder needles at each of the feeder and stitch sections A–D. The performance of the ground loop forming sinker 30 is illustrated by line L-2 and the performance of the pile loop forming sinker 50 is illustrated by line L-3. The longitudinal relationship between the needle performance line L-1, ground loop forming sinker performance line L-2 and pile loop forming sinker performance line L-3 varies in accordance with the circumferential movement of the sinker cap on which sinker controlling cams (not shown) are mounted.

Each ground loop forming sinker 30 includes a body portion 31 which is received in the groove in the sinker cap (not shown) to slidably mount ground loop forming sinker 30 therein. A butt 32 projects upwardly from body portion 31 for engagement with a ground loop forming sinker controlling cam (not shown) which moves ground loop forming sinker 30 inwardly and outwardly relative to needles 20.

Sinker 30 includes an upper edge 33 and a release guide edge 34 which extends downwardly and rearwardly from the forward end of upper edge 33 at an acute angle relative to upper edge 33. Release guide edge 34 terminates at its lower end in a first sinker throat 35 defined between release guide edge 34 and the top edge 36 of a projection 37 extending forwardly of release guide edge 34 for a relatively short distance, but sufficient to maintain a ground yarn loop in first sinker throat 35. A second sinker throat 38 is defined by the bottom edge of projection 37 and the top edge 39 of ground loop forming sinker 30.

Pile loop forming sinker 50 includes a body portion 51 which is received in the groove in the sinker cap to slidably mount pile loop forming sinker 50 therein besides ground loop forming sinker 30. A butt 52 is carried by the body portion 51 for engagement with the sinker controlling cam (not shown). Butt 52 is disposed at a different location longitudinally of body portion 51 from butt 32 of ground sinker 30 so that pile loop forming sinker 50 may be operated independently of ground loop forming sinker 30 and vice versa.

Pile loop forming sinker 50 includes a first upper edge 53 which terminates at its forward end at the upper end of a first vertical edge 54. First vertical edge 54 terminates at its lower end at the rearward end of a pile length determining edge 55 and which forms a generally L-shaped edge. Pile length determining edge 55 terminates at its forward end at the upper end of a second generally vertical edge 56, which extends downwardly and rearwardly at an acute angle to the vertical and terminates at its lower end in a recess 57. A second upper edge 60 extends forwardly from recess 57 to its forward end which terminates at the rearward, upper end of a release edge 61. Release edge 61 extends forwardly and downwardly at an acute angle to the horizontal and terminates at the forward end of a trapezoidal edge 62 which extends downwardly and rearwardly and then upwardly and rearwardly to the upper end of a third vertical edge 63. Third vertical edge 63 extend downwardly to the rear end of a top edge 64 of the pile sinker 50. Trapezoidal edge 62, third vertical edge 63 and top edge 64 define a pile loop forming sinker throat 65.

The knitting method of the present invention will now be described with reference to FIGS. 1 and 6–12. At the ground yarn feeder section A, all of the needles 20 are raised to the knitting level by the needle selection and operating mechanism (not shown), of the circular knitting machine in a manner well known in the knitting art. Yarn carrier 21 feeds the ground yarn GY to the needles 20. The open latch tips of the needles 20 ascend higher than the second upper edge 60 of the pile sinker 50 and the old loops OLP of a pile yarn PY-1 or PY-2 and OLG of the ground yarn GY (formed in a previous stage) are cleared from the latch of needle 20, but remain on the shank of needle 20. This old loop OLG of the ground yarn GY is held in place by the second sinker throat 38 of the ground loop forming sinker 30, and the old loop OLP of a pile yarn PY-1 or PY-2 is held in place in recess 57 of the pile loop forming sinker 50.

Figure 7:
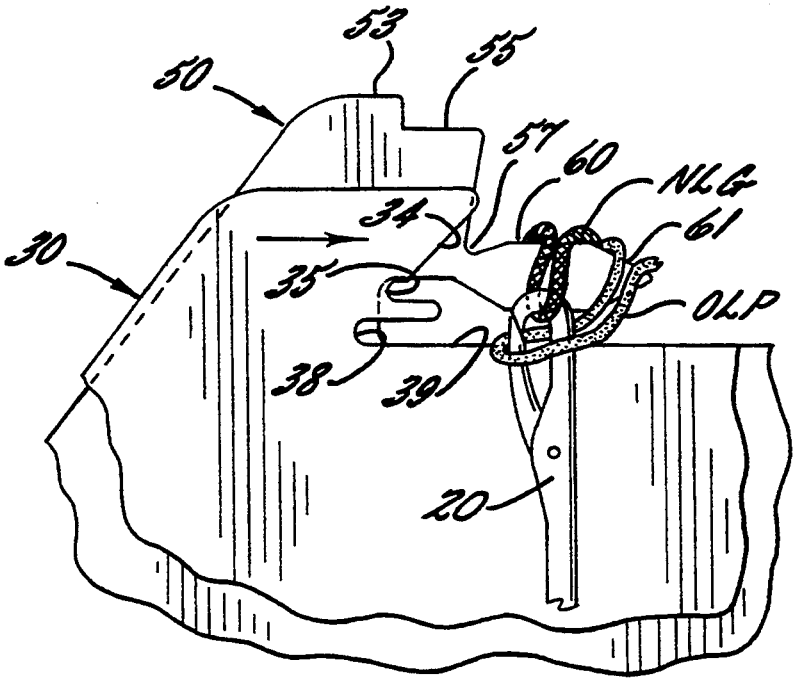

Referring to FIG. 7, the yarn carrier 21 has fed a ground yarn GY to the needle 20 and needle 20 is descending. The old loop OLP (for convenience, only one old loop is shown) closes the latch to capture a new loop NLG of the ground yarn GY. The new loop NLG is pulled down from the second upper edge 60 of the pile loop forming sinker 50, while the old pile loop OLP is released from the pile loop forming sinker by release edge 61.

Figure 8:
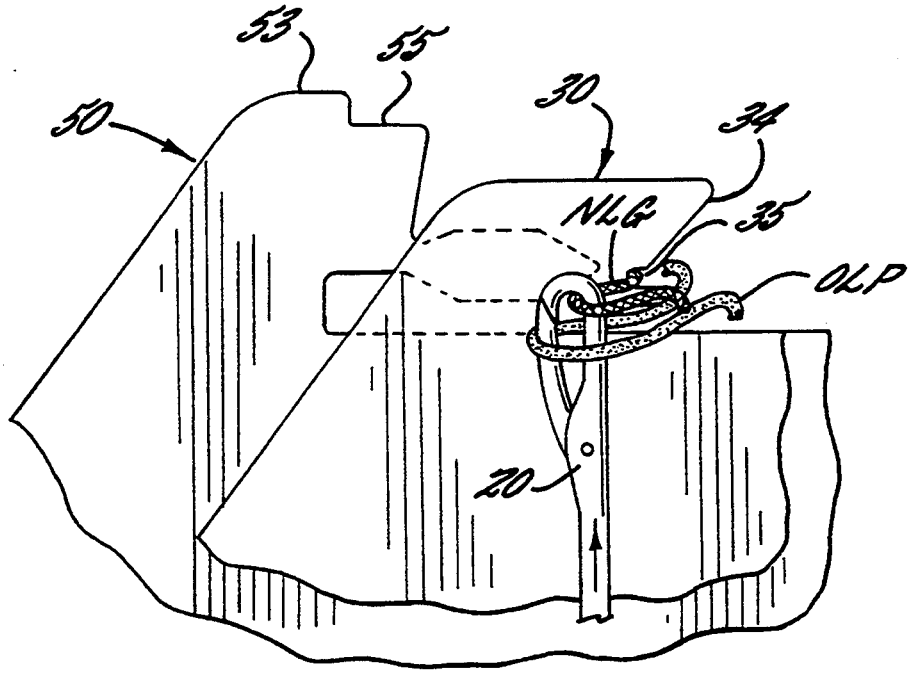

As the needle 20 descends and draws the new ground loop NLG over the second upper edge 60 of the pile loop forming sinker 50, the ground loop forming sinker 30 is moved inwardly and the release guide edge 34 engages the new ground loop NLG and moves the new ground loop off of the pile loop forming sinker 50. The new ground loop NLG is captured in the first sinker throat 35 of the ground loop forming sinker (FIG. 8). The ground yarn GY maintains the yarn length required for the formation of a stitch from the new ground loop NLG at the stitch section D by adjustment of the amount that ground loop forming sinker 30 pushes the new ground loop NLG. At the same time, the old pile loop OLP is released from the pile loop forming sinker 50 and is thereafter supported by the top edge 39 of the ground loop forming sinker 30.

Figure 9:
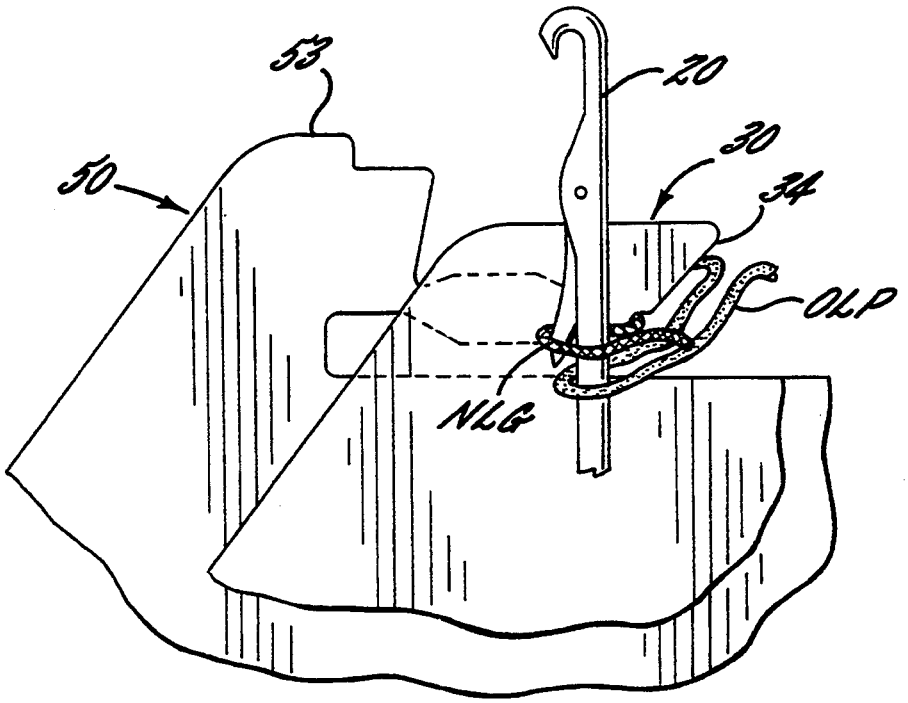

It is noted that the needle 20 does not descend far enough for the old loop OLP to be shed from the needle 20 before the needle 20 starts to ascend again. At the first pile yarn feeder section B, selected ones of the needles 20 ascend until the hook ends thereof are above the upper edge 53 of pile loop forming sinker 50, but not far enough for the new ground loops NLG to clear the latches thereof (FIG. 9). The non-selected needles 20 maintain the welt position in first pile yarn feeder section B.

The first pile yarn carrier 22 feeds a first pile yarn PY-1 to the selected needle 20 that is raised by the needle selection and operating mechanism (not shown). At the same time, the ground loop forming sinker 30 is partially retracted while holding the old pile loop OLP in the second sinker throat 38 and the new ground loop NLG in the first sinker throat 35 (FIG. 10).

Figure 10:
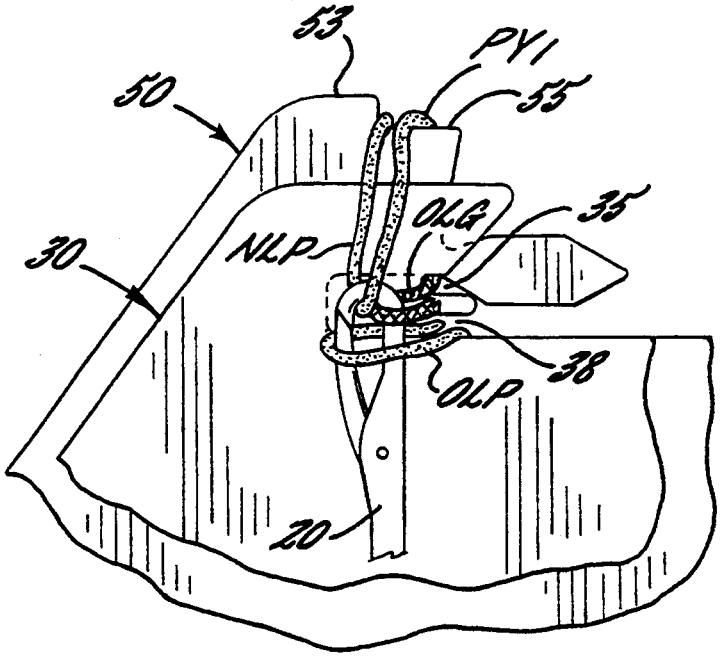

The hook of the needle 20 captures the first pile yarn PY-1 and commences the descend (FIG. 10). The old loop OLP closes the latch and the new pile loop NLP and the new ground loop NLG are both held in the hook of the needle 20. The new pile loop NLP is drawn over the pile length determining edge 55 of the pile loop forming sinker 50.

Figure 11:
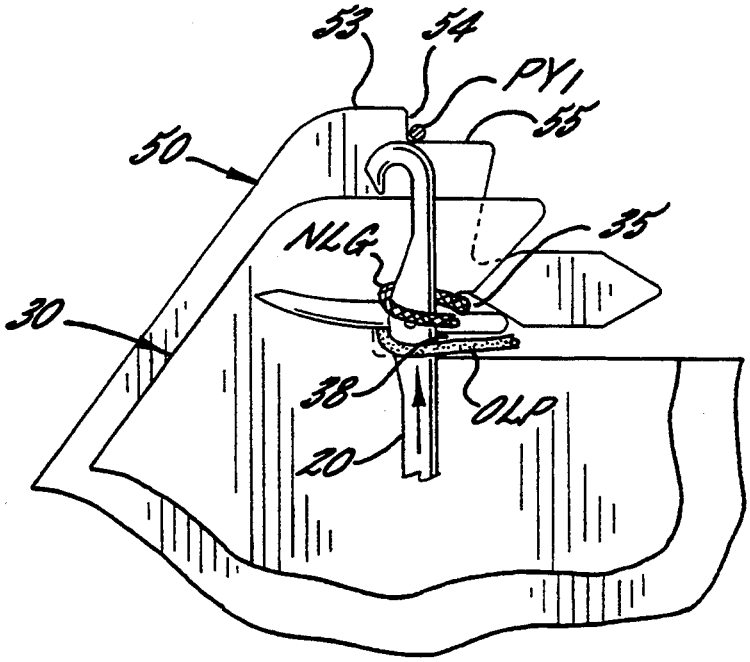

Referring now to FIG. 11, which shows the needle 20 and sinkers 30 and 50 at the second pile yarn feeder section C, the needles 20 that are selected to form pile loops from the second pile yarn PY-2 ascend toward the top of the sinkers 30 and 50. The latch thereof is opened by the new ground loop NLG thereon which is being held in the first sinker throat 35 of the ground loop forming sinker 30. The old loop OLP is held by the second sinker throat 38 of the ground loop forming sinker 30. The first pile yarn PY-1 is positioned at the juncture of vertical edge 54 and pile length determining edge 55 of the pile loop forming sinker 50 and is pushed inwardly by sinker 50 so that the needle 20 passes outwardly of the first pile yarn PY-1. Thus, the first pile yarn PY-1 is not caught by the hook of needle 20.

Needle 20 ascends sufficiently high to receive the second pile yarn PY-2 from yarn carrier 23, but not high enough for the new ground loop NLG to clear the latch of needle 20. Needle 20 then descends to draw a new pile loop NLP in the second pile yarn PY-2.

The needles 20 which ascended and received the first pile yarn PY-1 in the first pile yarn feeder section B maintain the welt position throughout the second pile yarn feeder section C. The old loop OLP is held in the second sinker throat 38 of the ground loop forming sinker 30, the new ground loop NLG is held in the first sinker throat 35 of sinker 30 and the new pile loop NLP is held on the pile length determining edge 55 at the juncture thereof with vertical edge 54 of the pile loop forming sinker 50.

All of the needles 20 then move successively through the stitch forming section D which determines the stitch size. All of the cylinder needles 20 descend and the pile loop forming sinkers 50 are retracted outwardly toward the periphery of the cylinder so that the new pile loops NLP of both pile yarns PY-1 and PY-2 are removed from the pile length determining edge 55, slip down the vertical edge 56 onto the second upper edge 60 and into the recess 57 (FIG. 12).

Figure 12:
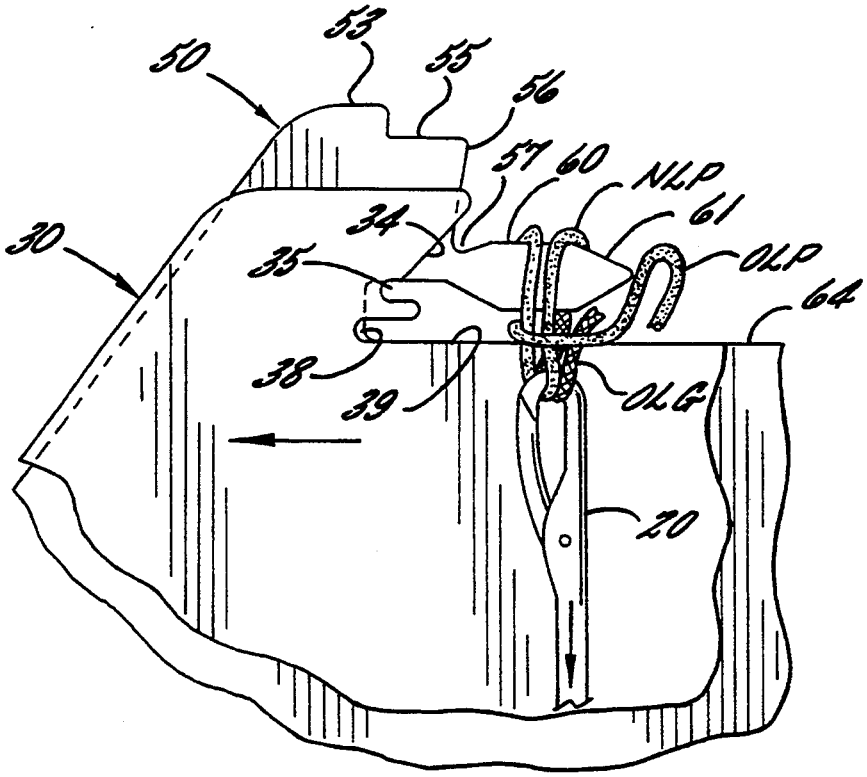

The ground loop forming sinker 30 is also moved outwardly in the direction of the periphery of the cylinder so that the new ground loop NLG which has been held in the first sinker throat 35 of the ground loop forming sinker 30 moves out of the throat 35 onto the sinker top edges 39 and 64 and the old loop OLP is released over the hook end of the needle 20 (FIG. 12).

The new pile loops NLP of the first pile yarn PY-1 and of the second pile yarn PY-2 are supported on the second upper edge 60 of the pile loop forming sinker 50. The size of the stitches of the ground yarn GY is determined by the retraction of the needles 20. A sufficient amount of ground yarn GY for the formation of the ground yarn stitches has been provided by the prior adjustable pushing movement of the ground loop forming sinker 30.

The ground loop forming sinker 30 next moves inwardly toward the needles 20 and the release guide edge 34 pushes the old pile loops OLP off of the second upper edge 60 of the pile loop forming sinker 50 and then off of the release guide edge 61 thereof. The pile loop forming sinker 50 then moves inwardly toward the needles 20 and the new pile loops NLP move into recess 57 and the pile stitches are tightened by vertical edge 56 to a tense condition to maintain their uniformity.

A jacquard pattern fabric is knit by repeating the foregoing steps in connection with the sections A–D. Alternatively, instead of all cylinder needles 20 being raised in ground yarn feeder section A, every other needle 20 can be selected to knit at each odd numbered ground yarn feeder section A and intervening needles 20 can be selected to welt. At each even numbered ground yarn feeder section A, the intervening needles 20 will be selected to knit the alternating needles will be selected to welt.

Figure 4:
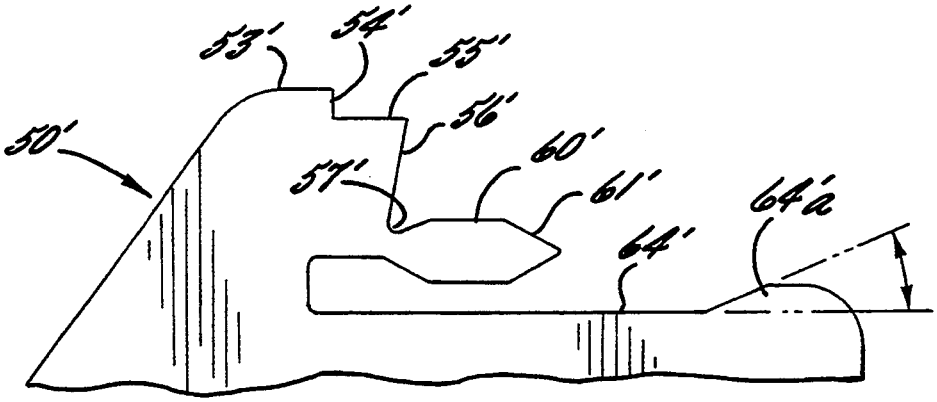
FIG. 4 is a fragmentary side elevational view similar to FIG. 2 of another embodiment of the pile loop forming sinker of the present invention.

Referring now to FIG. 4, there is illustrated therein another embodiment of the pile loop forming sinker in which like reference characters are used with the prime notation added. All parts of the pile loop forming sinker 50' are identical to pile loop forming sinker 50 previously described except for the top edge 64'.

Figure 13:
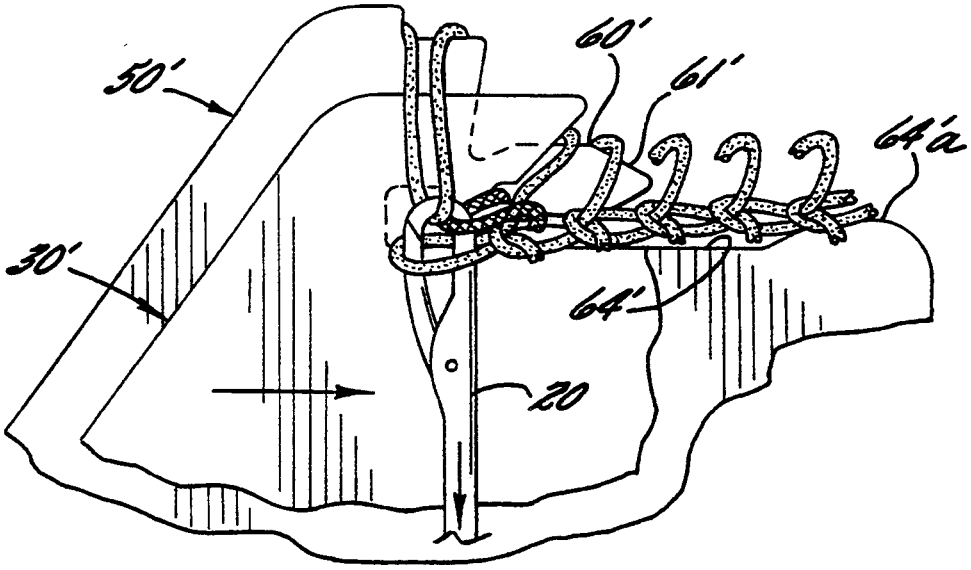
FIG. 13 is a view similar to FIG. 10 illustrating the use of the pile loop forming sinker of FIG. 4.

In forming a knit fabric having low pile (as shown in FIG. 13), it is deemed desirable to raise the fabric as it leaves the top edge 64'. Accordingly, a projection or hump 64'*a* is provided in the top edge 64' adjacent the outer end of the pile loop forming sinker 50'. The projection 64'*a* makes it easy to scoop up the old pile loop OLP' formed in the previous process to the second upper edge 60' of the pile loop forming sinker 50' while the sinker cam (not shown), which is a control device established to adjust the pushing amount, pushes out the ground loop forming sinker 30' to stretch the old pile loop OLP' that is scooped up by the release guide edge 61' of the pile loop forming sinker 50' so that the loop length of the low pile is made constant to form a stable low pile fabric.

Figure 5:
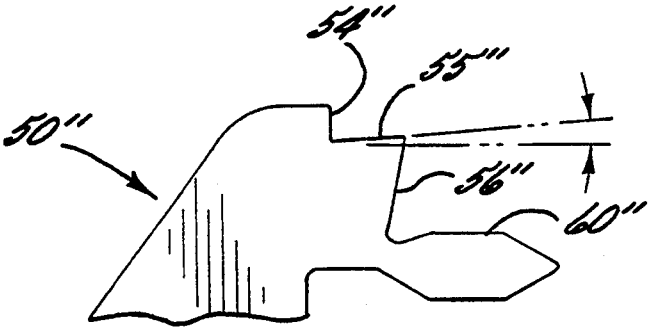
FIG. 5 is a fragmentary side elevational view similar to FIGS. 2 and 4 of a further embodiment of the pile loop forming sinker of the present invention.
Figure 6:
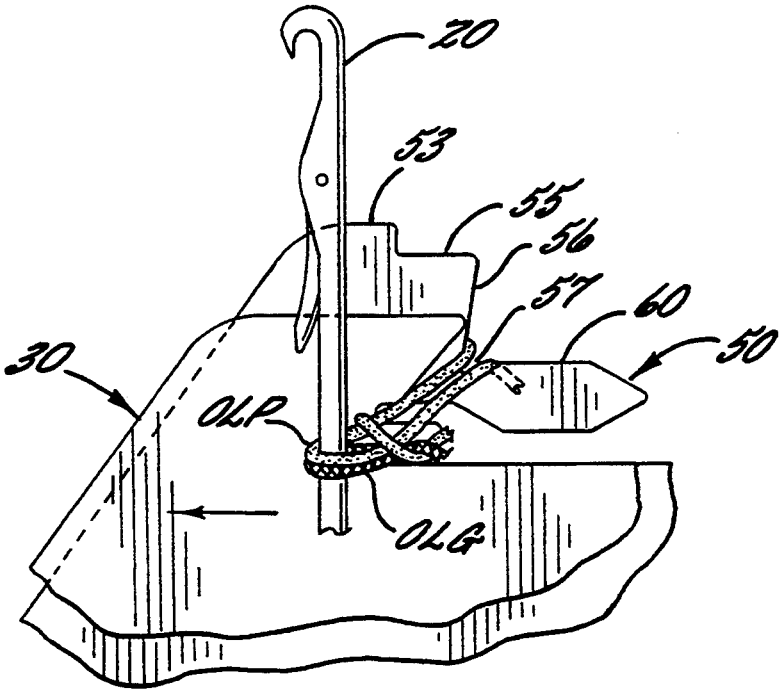
FIGS. 6 through 12 are successive, fragmentary, enlarged vertical sections, illustrating the relative positions of the needles and sinkers during the knitting procedure in accordance with the method of the present invention, taken substantially along respective lines 6—6 through 12—12 in FIG. 1.

Still another embodiment of the pile loop forming sinker of the present invention is shown in FIG. 5, in which like reference characters with the double prime notation are used. All features of pile loop forming sinker 50" are identical to pile loop forming sinker 50 previously described except for the pile length determining edge 55". Pile length determining edge 55" is slanted upwardly and outwardly at an acute angle to the horizonal from vertical edge 54". Accordingly, the new pile loops formed from pile yarns PY-1 and PY-2 move to the guide edge 56" in a delayed manner in the stitch forming section D. Thus, the pile yarn loops and the ground yarn loops are separated from each other until the old loops are cleared from the hooks of the needles. As a result, stable plating piles are obtained regardless of the quality of the yarns that are used.

In the drawings and specifications, there has been set forth a preferred embodiment of the invention, and although specific terms are employed, they are used in a generic and descriptive sense only and not for purposes of limitation.

That which is claimed is:

1. A method of knitting a jacquard pile fabric on a circular knitting machine which includes cylinder needles having latches thereon and being mounted in grooves in a rotating cylinder and controlled by a jacquard needle selection and operating mechanism, and a ground loop forming sinker and a pile loop forming sinkers mounted in the same groove of a sinker cap mounted on the top of the rotating cylinder and individually and independently controlled by sinker cam means, said method comprising the steps of:

(a) providing a ground yarn feeder section and moving the cylinder needles and sinkers through the ground yarn feeder section while raising the cylinder needles to a knitting position, feeding a ground yarn to the cylinder needles, forming ground yarn loops comprising a ground yarn needle loop and a ground sinker loop by lowering the cylinder needles while moving the ground loop forming sinkers inwardly to push the ground sinker loops from a second upper edge of the pile loop forming sinkers and into a first sinker throat on the ground loop forming sinkers, (b) providing a first pile yarn feeder section adjacent and downstream of the ground yarn feeder section relative to the rotation of the cylinder and moving the cylinder needles and sinkers through the first pile yarn feeder section while raising selected ones of the cylinder needles to a tucking position while maintaining the remainder of the cylinder needles in a welting position and without clearing the ground yarn needle loops from the latches of the needles, feeding a first pile yarn to the selected cylinder needles that have been raised to the tucking position, and forming first pile yarn loops comprising a first pile yarn needle loop and a pile loop forming sinker loop by lowering the selected cylinder needles and retracting the first pile yarn from a pile length determining edge of the pile loop forming sinker which is higher than the second upper edge of the pile loop forming sinker from which the ground yarn is retracted, all while maintaining the ground sinker loop in the first sinker throat of the ground loop forming sinker, (c) providing a second pile yarn feeder section adjacent and downstream of the first pile yarn feeder section and moving the cylinder needles and sinkers through the second pile yarn feeder section while raising to the tucking position the cylinder needles that were maintained in the welting position in the first pile yarn feeder section without clearing the ground yarn needle loops from the latches of the needles and while maintaining in the welting position those needles raised to the tucking position in the first pile yarn feeder section, feeding a second pile yarn to the needles occupying the tucking position, and forming second pile yarn loops comprising a second pile needle loop and pile sinker loop by lowering the cylinder needles and retracting the second pile yarn from the pile length determining edge of the pile loop forming sinker, all while maintaining the ground sinker loop in the first sinker throat of the ground loop forming sinker, and (d) providing a stitch forming section adjacent to and downstream of the second pile yarn feeder section and moving the cylinder needles and sinkers through the stitch forming section while forming double plating loops comprising a ground yarn loop and a pile yarn loop and clearing old sinker loops from the sinker tops and old needle loops from the needles.

2. A method according to claim 1 wherein multiple ground yarn, first and second pile yarn and stitch forming sections are provided and wherein at odd numbered ground yarn feeder sections every other cylinder needle is selected to knit and intervening cylinder needles are selected to welt, and at even numbered ground yarn feeder sections intervening cylinder needles are selected to knit and alternating needles are selected to welt.

3. A method according to claim 1 wherein the ground loop forming sinkers push the ground sinker loops by adjustable amounts to ensure that sufficient ground yarn is made available for stitch formation without the risk of ground yarn breakage.

4. A method according to claim 1 wherein the cylinder needles have hooks and at the ground yarn feeder section all cylinder needles are raised to the knitting position and then are lowered while being fed with the ground yarn, and the cylinder needles then are moved in the welt position while holding at the needle hook the old loop formed previously that is almost cleared from the needle hook at the position where the tip of the needle hook projects slightly above the sinker top edges.

5. A method according to claim 4 wherein the ground yarn loop formed at the second upper edge of the pile loop forming sinker is moved to the first sinker throat by advancing the ground loop forming sinker while retracting the pile loop forming sinker.

6. A method according to claim 5 wherein the ground yarn is held in the first sinker throat such that the ground yarn gets hooked by the cylinder needles separately from the first and second pile yarns that are formed subsequentially in the movement of the needles and sinkers to the stitch forming section whereby stable plating of the ground and pile loops occurs.

7. In a circular knitting machine for knitting a jacquard pile fabric including a cylinder having needle grooves in the periphery thereof, cylinder needles having hooks and latches and being slidably mounted in the needle grooves, a sinker cap carried by the top of the cylinder and having sinker grooves extending radially toward the cylinder needles, the combination therewith of a pile loop forming sinker and a ground loop forming sinker mounted in juxtaposed relation in each of the sinker grooves of the sinker cap for independent sliding movement, said pile loop forming sinker having an L-shaped edge adapted to hold a first or second pile yarn thereon, a pile length determining edge for determining the pile length of pile loops formed by the pile loop forming sinker, a vertical edge extending downwardly from the pile length determining edge and terminating in an upwardly and outwardly opening recess, a second upper edge extending outwardly from the recess for securing the formation of a ground yarn loop and for holding pile yarn loops during stitch formation, a release edge that extends from the second upper edge diagonally downwardly to a mouth of a sinker throat to release the pile yarn loops after stitch formation, a top edge extending outwardly from the sinker throat, and an upwardly extending projection on an outer end portion of the top edge to raise the fabric above the level of the remainder of the top edge., and said ground loop forming sinker including an upper edge, a release edge extending downwardly and rearwardly from the upper edge at an acute angle to the vertical for releasing ground yarn sinker loops formed by the second upper edge of the pile loop forming sinker, a first sinker throat at the bottom of the release edge for receiving and holding the ground yarn loops during pile yarn loop formation, a second sinker throat spaced downwardly from the first sinker throat and separated therefrom by an outwardly extending projection for holding an old loop separated from the ground yarn loop held in the first sinker throat, and a top edge extending outwardly from the second throat.

8. A circular knitting machine according to claim 7 wherein said pile loop forming sinker and said ground loop forming sinkers have butts thereon at different positions whereby the pile loop forming sinker and the ground loop forming sinker may be controlled separately and independently.

9. A circular knitting machine according to claim 7 wherein the pile length determining edge extends outwardly and upwardly from a corner of the L-shaped edge at an acute angle to the horizontal.

* * * * *

UNITED STATES PATENT AND TRADEMARK OFFICE

CERTIFICATE OF CORRECTION

PATENT NO. : 5,390,511

DATED : February 21, 1995

INVENTOR(S) : Takao Shibata et al.

It is certified that error appears in the above-identified patent and that said Letters Patent is hereby corrected as shown below:

On the cover page, please insert under "References Cited - U. S. PATENT DOCUMENTS" the following:

| | | |
|---|---|---|
| 4,612,784 | 9/1986 | Plath |
| 4,989,421 | 2/1991 | Schmidt |
| 5,109,680 | 5/1992 | Pernick |

Column 2, line 29, after "by" insert --B--.

Column 8, line 31, after "edge" delete the period.

Signed and Sealed this

Twentieth Day of June, 1995

Bruce Lehman

*Attest:*

BRUCE LEHMAN

*Attesting Officer*

*Commissioner of Patents and Trademarks*